US008016147B2

(12) United States Patent
Broadhead et al.

(10) Patent No.: US 8,016,147 B2
(45) **Date of Patent: *Sep. 13, 2011**

(54) LOCKABLE CONTAINER WITH IMPROVED SLIDE LATCH AND LOCK

(75) Inventors: Robert Malcolm Broadhead, Grants Pass, OR (US); David Frank Whitehead, Romford (GB)

(73) Assignee: Checkpoint Systems, Inc., Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/695,453

(22) Filed: Jan. 28, 2010

(65) Prior Publication Data

US 2010/0126993 A1 May 27, 2010

Related U.S. Application Data

(60) Continuation of application No. 11/085,716, filed on Mar. 21, 2005, now Pat. No. 7,837,051, which is a division of application No. 09/958,432, filed as application No. PCT/GB00/01302 on Apr. 10, 2000, now Pat. No. 6,926,164.

(30) Foreign Application Priority Data

Apr. 9, 1999 (GB) ..... 9908080

(51) Int. Cl.
*B65D 51/00* (2006.01)
*E05B 73/00* (2006.01)
*E05C 19/00* (2006.01)

(52) U.S. Cl. ..... 220/230; 220/4.22; 220/836; 220/843; 220/844; 206/387.11; 292/116; 292/302; 70/57.1

(58) Field of Classification Search ..... 220/4.22, 220/843, 844, 836, 230; 206/387.11; 70/57.1; 292/302, 116, 87
See application file for complete search history.

(56) References Cited

U.S. PATENT DOCUMENTS

| | | | | |
|---|---|---|---|---|
| 2,866,574 | A | 12/1958 | Roumeliotis | |
| 5,193,707 | A | 3/1993 | Mizumura | |
| 5,598,728 | A | 2/1997 | Lax | |
| 5,760,689 | A | 6/1998 | Holmgren | |
| 5,762,187 | A | 6/1998 | Belden, Jr. et al. | |
| 5,782,350 | A | 7/1998 | Weisburn et al. | |
| 5,934,114 | A * | 8/1999 | Weisburn et al. | 70/57.1 |
| 5,944,185 | A * | 8/1999 | Burdett et al. | 206/387.11 |
| 6,059,135 | A | 5/2000 | James et al. | |
| 6,367,639 | B1 | 4/2002 | Mar | |
| 6,430,976 | B1 | 8/2002 | Mitsuyama | |
| 6,926,164 | B1 * | 8/2005 | Broadhead et al. | 220/230 |

* cited by examiner

*Primary Examiner* — Robin Hylton
(74) *Attorney, Agent, or Firm* — Sand & Sebolt

(57) ABSTRACT

A lockable container for an article comprises a frame which has an access opening, a closure member which is pivotally mounted in relation to the frame, and a latch member which is axially movable within the closure member between a latched position and an unlatched position. The latch member and the frame are each provided with one or more interengageable detents whereby when the closure member is in a closed position and the latch member is in the latched position the detents are engaged and prevent pivoting of the closure member. Movement of the latch member to the unlatched position causes the detents to disengage and permit pivoting of the closure member. The closure member is provided with a locking member for engaging the latch member to retain it against axial movement.

16 Claims, 7 Drawing Sheets

LOCKABLE CONTAINER WITH IMPROVED SLIDE LATCH AND LOCK

CROSS REFERENCE TO RELATED APPLICATIONS

This application is a continuation of U.S. patent application Ser. No. 11/085,716, filed Mar. 21, 2005, now U.S. Pat. No. 7,837,051, which is a divisional of U.S. patent application Ser. No. 09/958,432, filed May 2, 2002, now U.S. Pat. No. 6,926,164, which is the national stage application of International Application No. PCT/GB00/01302, filed Apr. 10, 2000, which in turn claimed priority from GB 9908080, filed Apr. 9, 1999; the disclosures of which are incorporated herein by reference.

FIELD OF THE INVENTION

The present invention relates to a lockable container, notably a lockable container for displaying prerecorded storage media such as digital versatile discs (DVDs), video cassettes or compact discs (CDs).

BACKGROUND INFORMATION

Pre-recorded storage media such as CDs and video cassettes are usually put up for sale in a plastic case or the like, which carries information about the disc or tape as well as carrying sales promotional material or artwork to attract a purchaser. To prevent theft of the media from a shop various lockable display containers have been proposed which house the disc or tape in its case and prevent a thief gaining access to the disc or tape without breaking the container or removing the container from the shop. The container can be fitted with alarm means so that it cannot be removed from the shop without actuating an alarm. One type of known container employs a spring loaded pin or the like which locates in a recess in a wall of the case, for example as disclosed in EP 0 312 172. Such containers can only be used with cases of a specific size, which have a recess which registers with the pin. Other types of container employ a spring loaded pin to retain a stop member over part of an access opening in the container, displacement of the pin by a magnet permitting the stop member to move out of the way of the access opening by translation or by translation and pivoting, for example as disclosed in EP 0 541 733 and EP 0 666 954.

Most lockable display containers have an access opening which is at least partly open at all times, to permit insertion and removal of the disc or tape in its case. A problem with such containers is that the disc or tape is only protected from damage at the opening by its case, which therefore needs to be tough. For cost reasons, however, it is desirable to make cases from more frangible materials such as cardboard or vacuum-formed plastics materials. Many DVDs, for example, are sold in soft, vacuum-formed plastics cases.

It has been proposed, in WO95/14841, to provide an anti-theft box comprising a cassette with an elongate opening at one face. The cassette has a lid which can be locked to cover the open end of the cassette. To lock the lid on the cassette, a lock mechanism is provided which comprises a lock slide which has lock bolts for engaging in holes in the lid and in a long side wall of the cassette. The lock slide is moved transversely to the long axis of the opening to lock and unlock the lid. The lock slide is moved by an operating slide which slides transversely to the movement of the lock slide, or by an operating pin which is passed from the lower side of the lock slide through a transverse slot in the lock slide and attached to the lock slide.

The present invention seeks to provide an improved lockable container for DVDs and other valuable items.

SUMMARY OF THE INVENTION

According to an aspect of the present invention there is provided a lockable container for an article, comprising a frame which has an access opening whereby an article can be inserted into or removed from the frame, and a closure member which is pivotally mounted in relation to the frame and pivotable between an open position in which an article can be inserted into or removed from the frame through the access opening and a closed position in which the closure member blocks substantially all of the access opening, the closure member housing an elongate latch member between a latched position and an unlatched position, the latch member and the frame each being provided with one or more interengageable detents whereby when the closure member is in the closed position and the latch member is in the latched position the detents are engaged and prevent pivoting of the closure member, the closure member being provided with a locking member adapted to move between a locked position at which the locking member engages the latch member so as to retain it against axial movement, and an unlocked position at which the locking member permits axial movement of the latch member.

The latch member may be of unitary construction for simplicity of manufacture. It may be moved to the latched position by pushing with a user's finger.

The frame could be a skeletal frame, but it is preferred that the frame has no openings other than the access opening, so that when the closure member is in the closed position an article contained within the frame cannot be tampered with.

The container of the invention is of particular use for storing and displaying DVDs and other media which are fragile or which have frangible or scratchable cases.

The frame preferably comprises two rectangular or square flat sides and four narrow sides, one of which provides the access opening.

The entire locking mechanism may be housed in the closure member, which may have external features to enable the container to be mounted in a display rack. This permits a plurality of containers to be stacked side by side without any part of the locking mechanism projecting sideways or upwards. Alternatively, the closure member could be provided with hanging means, for example a hook, to permit the container to be hung up without projections from the bottom or sides of the container taking up space.

The locking member can be a spring biased jaw or clamp which acts to grip the latch member. However it is preferred that the locking member positively engages with the latch member, for example by engaging in a slot or recess so that the latch member is positively secured in position once it reaches the latched position. A leaf spring or a spring-biased magnetic pin may be used. In a preferred embodiment, the locking member is a pin which is spring biased in a bore or recess in a basal wall of the closure member. The exposed head of the pin may locate in a hole in the latch member in a similar manner to the engagement of the pin and sliding rail in EP 0 541 733. The pin may be withdrawn from the latch member by means of a magnet, to permit the latch member to be slid to the unlatched position.

In a preferred embodiment, the latch member is biased to either the latched or the unlatched position by spring means.

To facilitate opening of the container, it is preferred that the latch member is biased to the unlatched position, so that when the locking member is moved to the unlocked position the latch member moves to the unlatched position.

When in the latched position, the latch member preferably prevents pivoting of the closure member to the open position by engagement of at least one of the detents with at least one tab on the closure member. This permits the container to be assembled by simply placing the latch member in the closure member. However, the invention is not limited to this embodiment, and other means could be used for preventing pivoting. For example, the closure member may be provided with a pocket or groove in which the latch member is slidably received.

BRIEF DESCRIPTION OF THE DRAWINGS

The invention will now be further described, by way of example, with reference to the following drawing in which.

DETAILED DESCRIPTION

The display container comprises a tough, transparent frame 2, for example of polycarbonate, a closure member 10 and a latch member 28.

Figure 1:
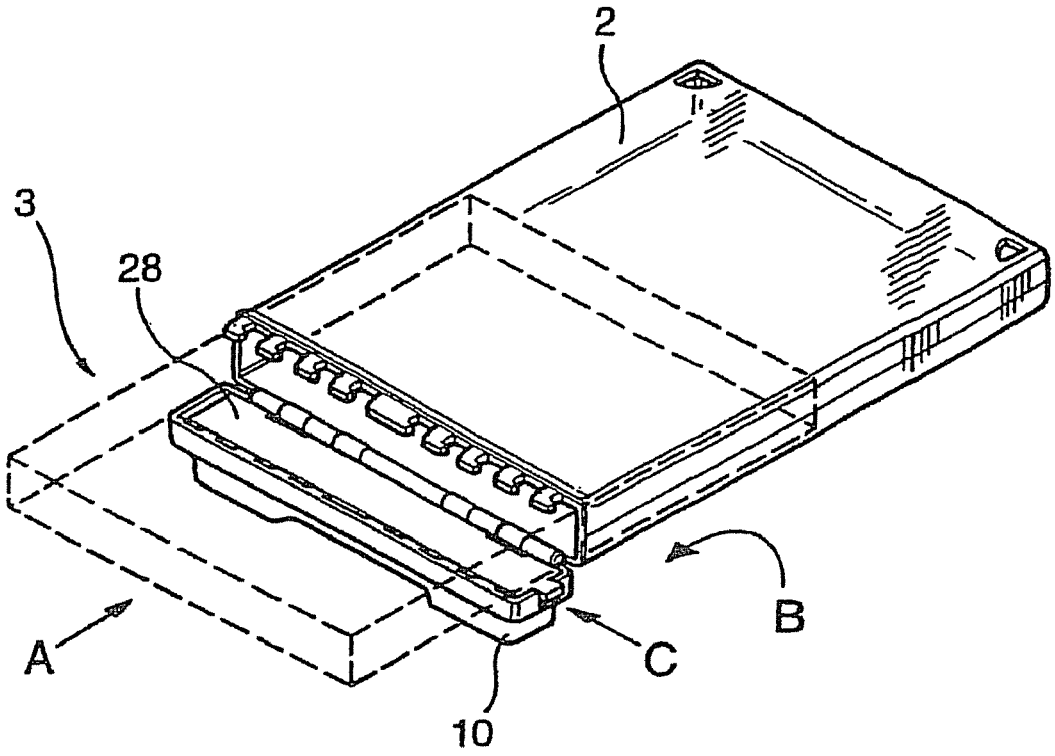
FIG. 1 is a perspective view of a lockable container for display of a DVD case in accordance with one aspect of the present invention.
Figure 2:
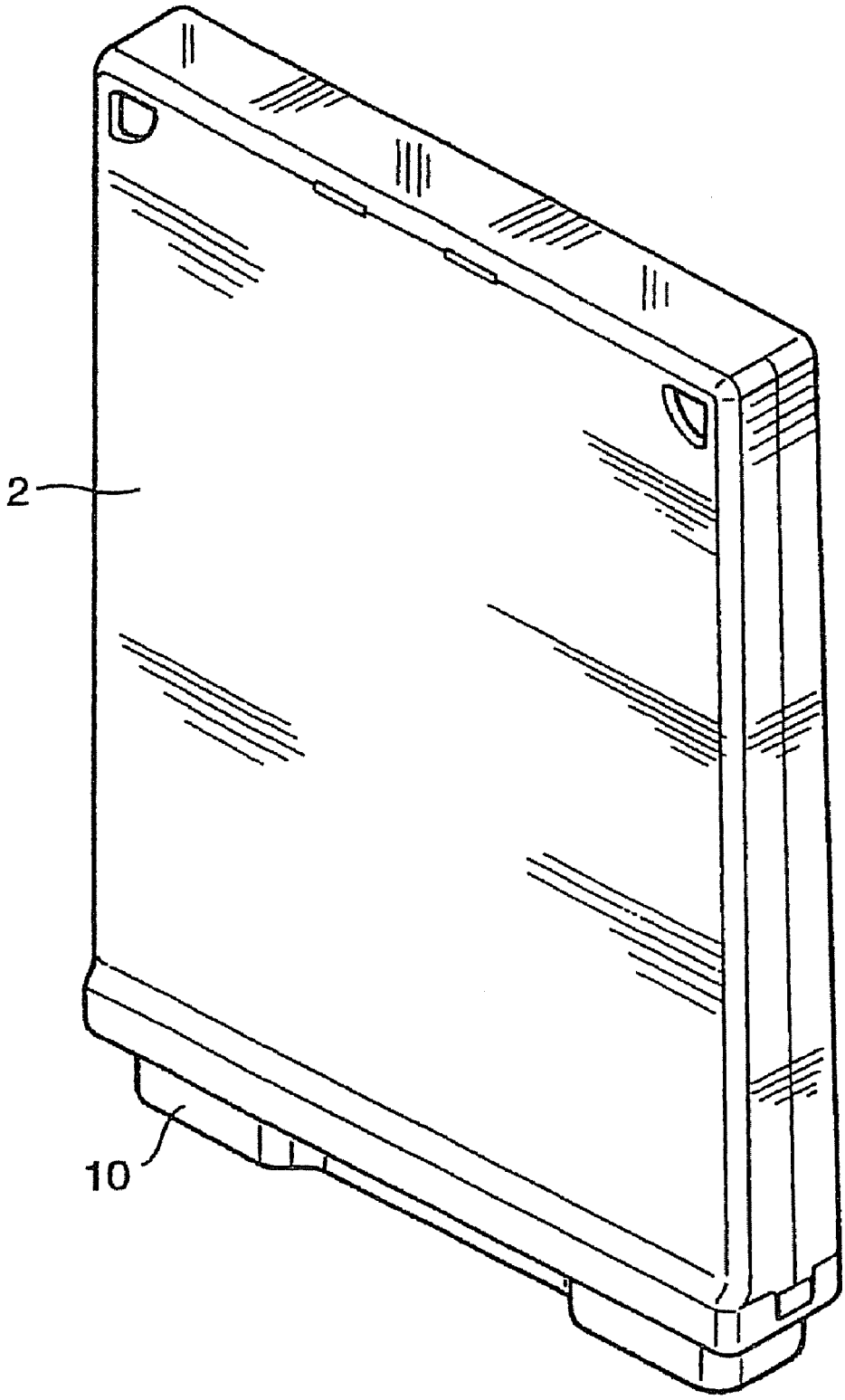
FIG. 2 is a perspective view of the lockable container of FIG. 1 in a locked state.
Figure 3:
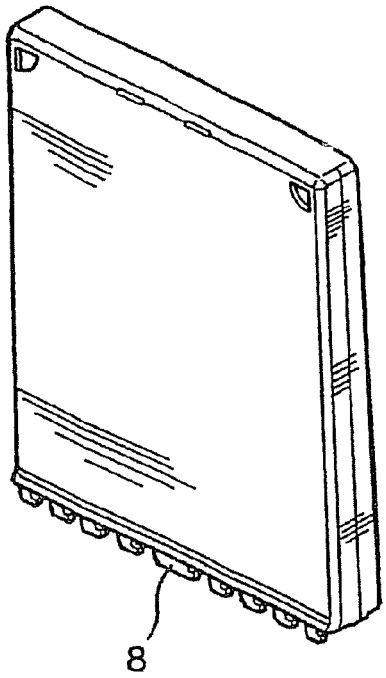
FIGS. 3 and 4 are perspective views of the frame of the lockable container of FIG. 1.

The frame 2 is in this example a generally parallelepipedic box having an elongate access opening 4 along one face. For manufacturing convenience, the frame 2 has two small wedge-shaped apertures at the bottom corners of one face. These apertures are not important or necessary for the functioning of the container, and could be eliminated so that the frame 2 has only a single opening. The frame 2 is dimensioned so that a case 3 for a DVD, shown in broken lines in FIG. 1, is a sliding fit within the container.

To lock the DVD case 3 in the container, the case 3 is fully inserted into the frame 2 in the direction of the arrow A. The frame is then pivoted about a hinge in the direction of the arrow B so that its access opening 4 is covered by the closure member 10. Finally, the elongate latch member 28 is pushed axially in the direction of arrow C to lock the closure member 10 to the frame 2 as will be explained below.

Figure 4:
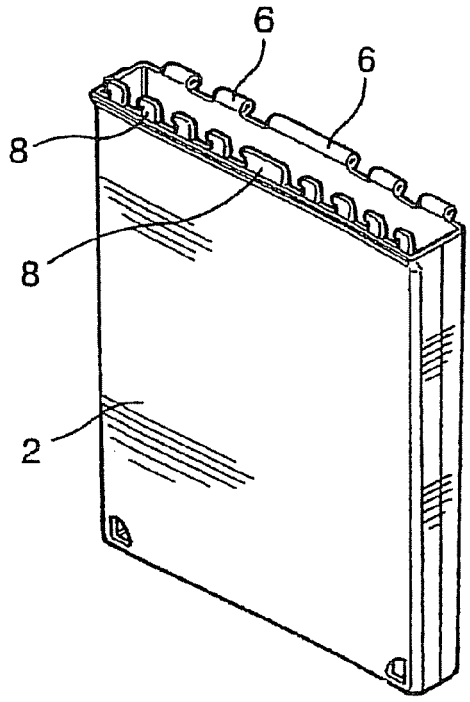
Figure 5:
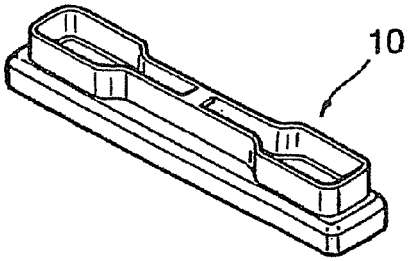
FIGS. 5 and 6 are perspective views of the closure member of the lockable container of FIG. 1.
Figure 7:
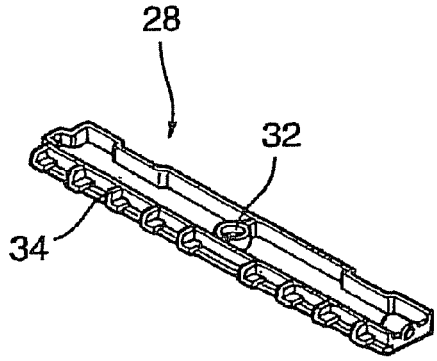
FIGS. 7 and 8 are perspective views of the latch member of the container of FIG. 1.
Figure 6:
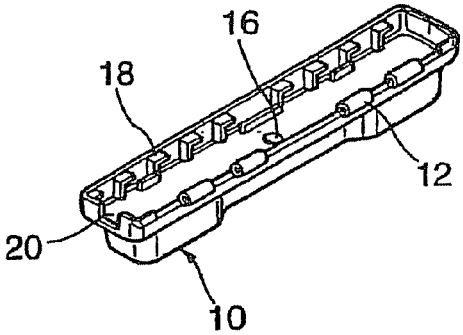
Figure 8:
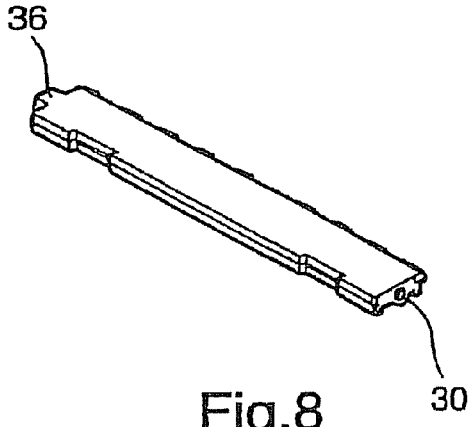
Figure 9:
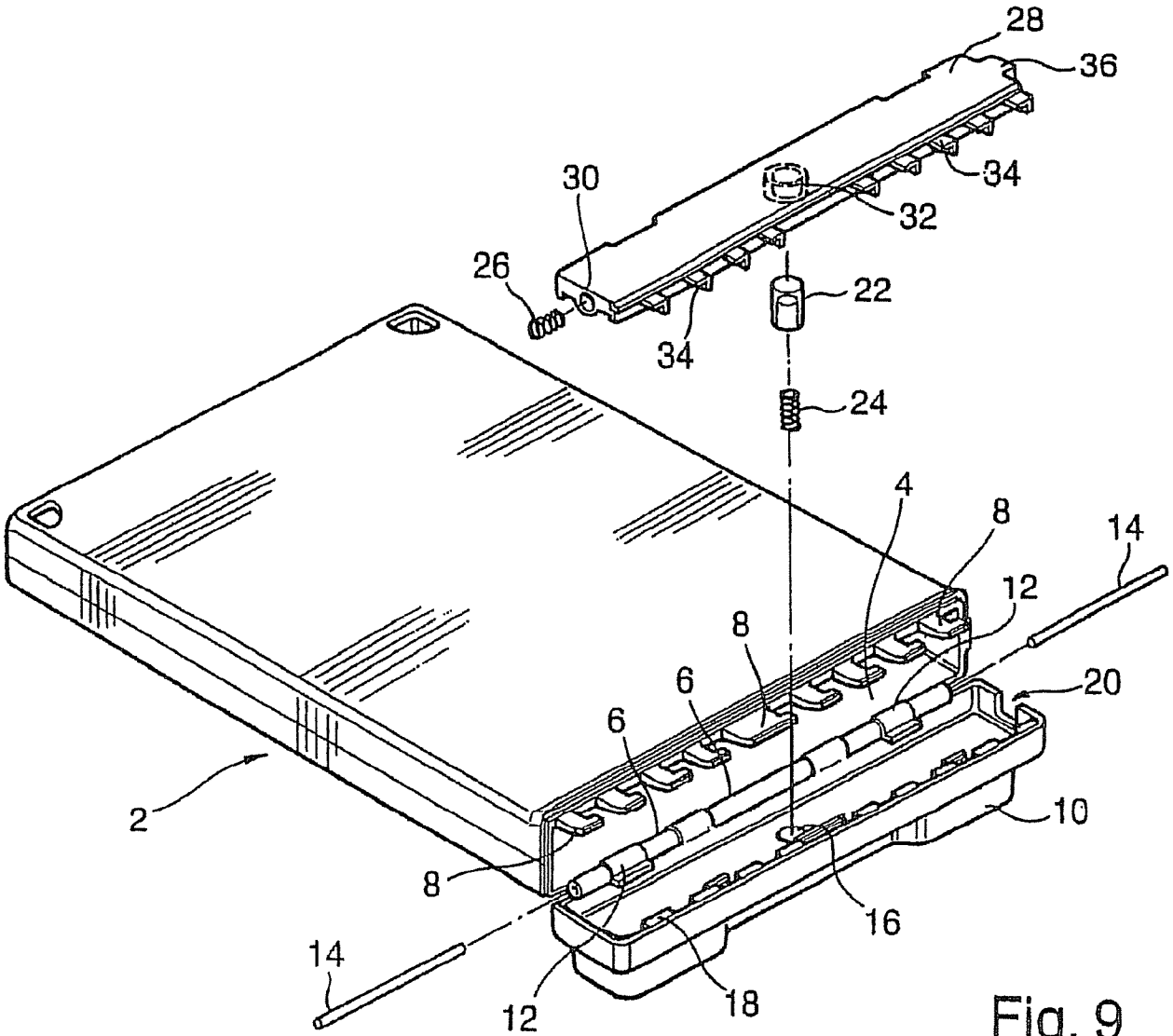
FIG. 9 is an exploded view of the lockable container of FIG. 1.

The frame 2 has hinge members 6 along one long edge of the access opening 4, and a plurality of generally L-shaped detent members 8 formed along the opposed edge, as best shown in FIG. 4. The closure member 10 has hinge members 12 along one long edge, as best shown in FIG. 6. The respective hinge members 6, 12 butt together side by side to form a pair of hinge housings having blind tubular bores into each of which is inserted a hinge pin 14. The hinge pin 14 is a close fit for the insides of the hinge members 6, 12 and, once inserted, cannot be removed without breaking the container.

Figures 10, 11, 12:
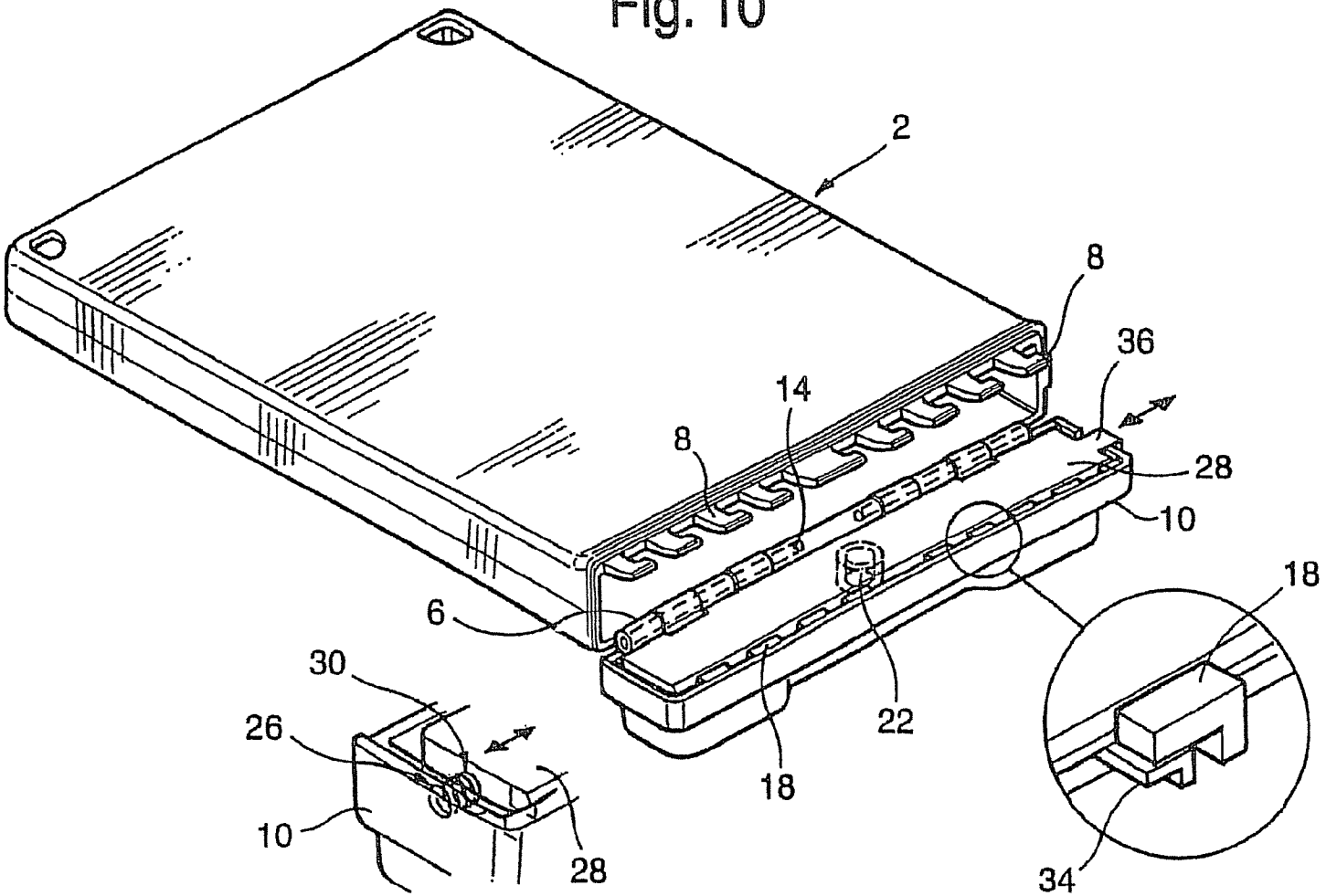
FIG. 10 is a perspective view of the container of FIG. 9 when assembled, with the closure member in an open position.
FIGS. 11 and 12 are enlarged partial X-ray views of details of the container of FIG. 10.

The latch member 28 is slidably housed in the closure member 10, retained by tabs 18 on the closure member 10. At one end of the latch member 28 is a blind bore 30 for receiving a spring 26. When the latch member 28 is housed in the closure member 10, the spring 26 biases the latch member to the right as shown in FIG. 10.

The closure member 10 has a blind bore 16 and the latch member 28 has a blind bore 32. A magnetically movable pin 22 sits in the bore 16 on the closure member, biased towards the latch member 28 by a spring 24. If the latch member is pushed to the left as shown in FIG. 10, for example by the action of a user's finger on a nub 36 which projects through an aperture 20 in the closure member, the bores 16, 32 move into register and the pin 22 is urged transversely to locate in the bore 32 in the latch member thereby preventing axial movement of the latch member.

To protect an article in the frame 2, the closure member 10 is pivoted about the hinge members 6, 12, with the latch member 28 in the unlatched position so that the closure member 10 completely blocks the access opening 4. In this closed position, the tabs 18 on the closure member and the detents 34 on the latch member are disposed in spaces adjacent to the detents 8 on the frame 2. The user pushes the nub 36 until the pin 22 engages in the latch member 28 as described above, thereby locking the latch member and preventing sliding movement of the latch member. In this position, the detents 34 on the latch member 28 engage with the detents 8 on the frame 2, thereby preventing pivoting of the closure member 10 away from the closed position.

Figure 13:
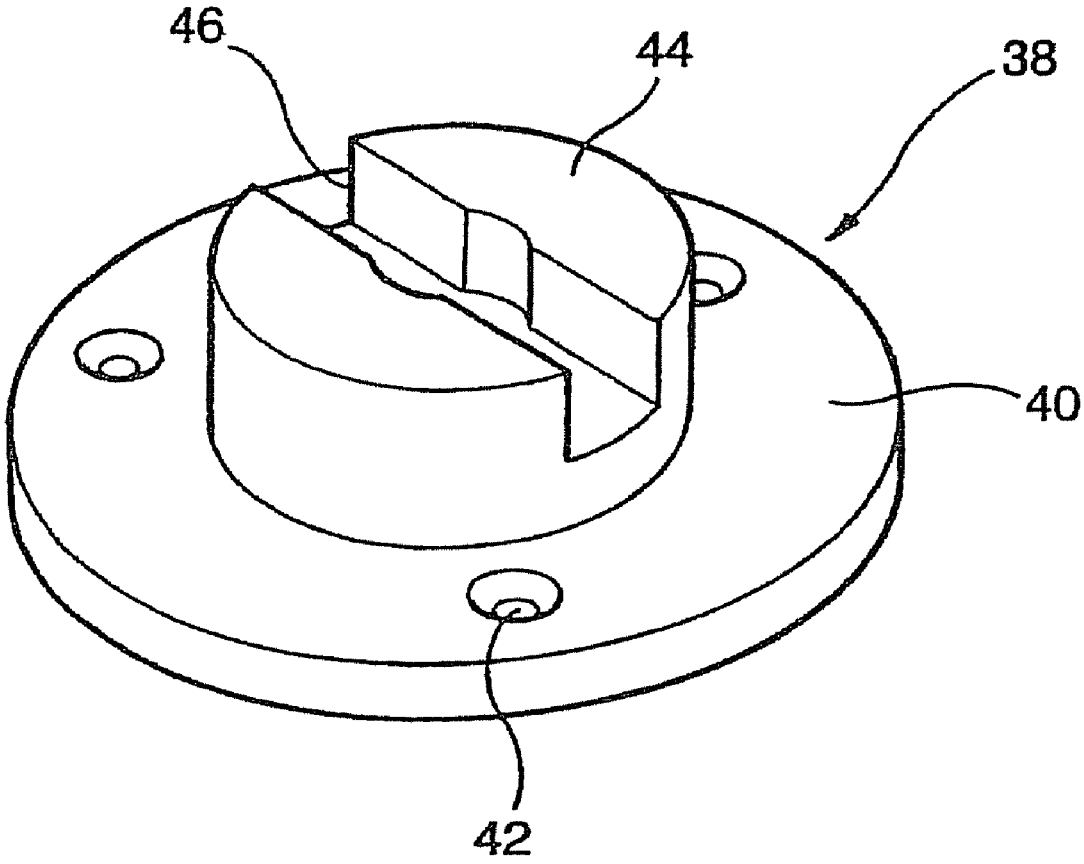
FIG. 13 shows a known magnetic device for releasing the locking member in a container in accordance with the present invention.

To open the container, a known magnetic release device 38 (FIG. 13) is used by the sales person. The magnetic release device 38 comprises a base plate 40 having screw holes 42 by which it is secured to a work surface (not shown). The base plate 40 carries a circular magnet 44 having a transverse diametric groove 46 cut in it. When the closure member 10 is inserted into the groove 46 the magnet 44 pulls the locking pin 22 to cause the pin 22 to withdraw fully from the bore 32 in the latch member 28. The spring 26 pushes the latch member 28 to the unlatched position, allowing the container to be opened by pivoting of the closure member to the open position.

The external face of the closure member 10 may be shaped to enable the container to stand up in a rack, or to be hung on a hook.

The invention provides a lockable container for protecting and displaying an article at point of sale, for example a DVD or a video cassette, optionally with packaging material to brace the product inside the container.

All the components of the container, except for the pin 22 and springs 24, 26 can be fabricated from injection molded plastics materials which may be transparent or translucent. It is also envisaged that, as known per se, the interior of the container would be provided with a magnetic strip or the like which activates an alarm system if the container is removed without proper authorization.

The invention claimed is:

1. A lockable container for an article comprising a frame which has an access opening whereby an article can be inserted into or removed from the frame, and a closure member which is pivotally mounted in relation to the frame and pivotable between an open position in which an article can be inserted into or removed from the frame through the access opening and a closed position in which the closure member blocks substantially all of the access opening, the closure member housing a latch member axially movable with respect to the closure member between a latched position and an unlatched position, the closure member being provided with a locking member adapted to move between a locked position at which the locking member engages the closure member in the latched position and the locking member retains the latch member against axial movement, and an unlocked position at which the locking member permits axial movement of the latch member, wherein;

the frame is provided with a detent and the closure member is provided with a tab disposed adjacent to the detent when the closure member is in the closed position, and the latch member is provided with a detent disposed between and engaging with the detent of the frame and the tab when the latch member is in the latched position so that the latch member prevents pivoting of the closure member to the open position, the detent on the latch member disengaging from the detent on the frame when the latch member is moved to the unlatched position, thereby permitting the closure member to be pivoted to the open position; and wherein said detents on said frame and said detents on said latch member are L-shaped or hook shaped.

2. A lockable container as claimed in claim 1, wherein the frame is provided with a plurality of detents, and the closure member is provided with a plurality of tabs which are disposed adjacent to the frame detents when the closure member is in the closed position, and wherein the latch member is provided with a plurality of detents which are disposed between and engage with the detents of the frame and the tabs when the latch member is in the latched position so that the latch member prevents pivoting of the closure member to the open position, the detents on the latch member disengaging from the detents on the frame when the latch member is moved to the unlatched position, thereby permitting the closure member to be pivoted to the open position.

3. A lockable container as claimed in claim 1, wherein the locking member is a pin biased by a spring and movable in response to a magnetic field of suitable magnitude.

4. A lockable container as claimed in claim 1, wherein the closure member is pivotably connected to the frame by a hinge comprising at least one hinge housing and at least one hinge pin journaled in a blind bore in the housing, no part of the hinge pin projection beyond the entrance to the housing.

5. A lockable container as claimed in claim 1, wherein the latch member is of unitary construction.

6. A lockable container as claimed in claim 1, wherein the latch member surrounds an inner portion and an outer portion of the frame detent and the closure member tab.

7. A lockable container for an article, comprising:

a frame which has an access opening having two opposed long edges and two opposed short edges whereby an article can be inserted into or removed from the frame;

a closure member which is pivotally mounted in relation to the frame and pivotable between an open position in which an article can be inserted into or removed from the frame through the access opening and a closed position in which the closure member blocks substantially all of the access opening;

the closure member retaining an elongate latch member which is axially movable with respect to the closure member between a latched position and an unlatched position along an axis parallel to said long edges;

the latch member being provided with a detent;

the frame being provided with a detent;

whereby, when the closure member is in the closed position and the latch member is in the latched position, said detent on the latch member will engage with said detent on the frame and the latch member preventing pivoting of the closure member;

whereby movement of the latch member to the unlatched position will cause the detents to disengage and permit pivoting of the closure member; and the closure member being provided with a locking member adapted to move between a locked position at which the locking member engages the closure member so as to retain the latch member against axial movement, and an unlocked position at which the locking member permits axial movement of the latch member; and wherein said detent on the latch member is L-shaped or hook-shaped.

8. A lockable container as claimed in claim 7, wherein the closure member is provided with a tab which is engaged by said detent on the latch member when the latch member is in the latched position so that the latch member prevents pivoting of the closure member to the open position.

9. A lockable container as claimed in claim 7, wherein the closure member housing prevents tampering with the latch member when in the latched position.

10. A lockable container as claimed in claim 7, wherein the latch member extends beyond an end portion of the closure member housing in the unlatched position and is flush with the end portion in the latched position.

11. A lockable container as claimed in claim 10, wherein a second end of the closure member housing prevents access to the latch member.

12. A lockable container as claimed in claim 7, wherein the latch member is only accessible from one side when the closure member is in the closed position.

13. A lockable container as claimed in claim 7, wherein the latch member includes a receiving opening and the frame detent is located within the receiving opening when the closure member is in the closed position.

14. A lockable container as claimed in claim 13, wherein the receiving opening moves axially with the latch member when the latch member is in the latched position and the frame detent cannot traverse the receiving opening in the latched position.

15. A lockable container as claimed in claim 7, wherein the receiving slot is inaccessible when the closure member is in the closed position.

16. A lockable container for an article comprising a frame which has an access opening whereby an article can be inserted into or removed from the frame, and a closure member which is pivotally mounted in relation to the frame and pivotable between an open position in which an article can be inserted into or removed from the frame through the access opening and a closed position in which the closure member blocks substantially all of the access opening, the closure member including a latch member axially slidably on the closure member and movable between a latched position and an unlatched position, the closure member being provided with a locking member adapted to move between a locked position where the locking member engages the closure member in the latched position wherein the locking member retains the latch member against axial slidable movement toward the unlatched position, and an unlocked position wherein the locking member permits axial slidable movement of the latch member toward the unlatched position;

the locking member including a pin biased by a spring into locking engagement with the closure member upon a bore formed in the latch member moving into registry with a bore formed in the closure member, wherein said pin and spring is mounted in one of said bores to retain the locking member in the locked position, and wherein the pin is movable toward the unlocked position in response to an applied magnetic field; and said frame being provided with at least one L-shaped detent and the latch member being provided with at least one L-shaped detent which engages with the L-shaped detent of the frame when the latch member is in the latched position so that the latch member prevents pivoting of the closure member to the open position, the L-shaped detent on the latch member disengaging from the L-shaped detent on the frame when the latch member is moved to the unlatched position, thereby permitting the closure member to be pivoted to the open position.

* * * * *